United States Patent [19]

Leo

[11] 4,063,680

[45] Dec. 20, 1977

[54] BETTING TRAY

[76] Inventor: Gerry Leo, 2590 Haig Ave., Montreal, Quebec, Canada

[21] Appl. No.: 706,268

[22] Filed: July 19, 1976

[51] Int. Cl.[2] ..... G07B 15/00

[52] U.S. Cl. ..... 232/1 D; 133/1 R; 222/427

[58] Field of Search ..... 232/1, 4; 222/144, 427; 221/132, 137; 273/148; 133/1 R, 3 R

[56] References Cited

U.S. PATENT DOCUMENTS

| | | | |
|---|---|---|---|
| 160,085 | 2/1875 | Dennick | 222/427 |
| 412,817 | 10/1889 | Willis | 222/427 X |
| 698,044 | 4/1902 | Nouzaret | 222/144 X |
| 3,583,603 | 6/1971 | Freckmann et al. | 222/427 X |
| 3,716,183 | 2/1973 | Chaves | 232/9 X |

*Primary Examiner*—Roy D. Frazier
*Assistant Examiner*—Peter A. Aschenbrenner

[57] ABSTRACT

An annular tray having numbered compartments, downward and inward sloping bottom on no inner side surrounds a separate central cylindrical container having vertical sides. When assembled, the sides of the central container form an inner side to the numbered compartments of the annular tray such that objects such as betting chips or coins placed in the numbered compartments are restrained from falling out. When the annular tray is raised while leaving the cylindrical container resting on the original surface, the objects in the compartments are no longer restrained by the walls of the cylindrical container, but instead, fall downward and inward into the cylindrical container from when they are readily retrieved.

7 Claims, 4 Drawing Figures

BETTING TRAY

BACKGROUND OF THE INVENTION

In games of chance wherein two or more players place bets of cash or betting tokens, it has been difficult to insure that each player has "ante'd" his aliquot share in order to remain in the game. In addition, cash or tokens have frequently become scattered over the table and mixed with discarded, played or undealt cards, making inconvenient and time consuming the collection of the pot by the winner.

The prior art discloses cups or trays in which coins are placed for easy removal such as shown in U.S. Pat. Nos. 1,022,442 in the name of L. T. Sowage and 3,011,789 in the name of F. B. Eliassen et al. In addition, coin trays of both rectangular and circular shape, some with compartments, are shown in U.S. Pat. No. 646,525 in the name of E. M. Knight. A game board, with a central money cup and numbered locations on the surface, was disclosed in U.S. Pat. No. 74,368 in the name of H. Jackson.

SUMMARY OF THE INVENTION

The present invention discloses a compartmented annular money or betting token tray with a downward, inward sloping bottom The compartments in the annular tray lack inner sidewalls. A cylindrical container which fits into the opening in the center of the annular tray provides the inner sidewall to prevent objects placed in the numbered compartments from sliding downward and inward into the center opening in the annular tray. The compartments of the tray are numbered and it is agreed by the players beforehand that the bets of each player will be deposited in a certain numbered compartment. In this way, the amount of money or tokens actually put into play by any player can at any time be ascertained by merely counting the coins or tokens in the compartment bearing his number.

When the winner of the pot is ascertained, the winner merely raises the annular tray, using a handle provided for that purpose. As the annular tray clears the wall of the cylindrical container, all of the coins or tokens, deprived of the restraint provided by the sides of the cylindrical container, slide downward and inward into the interior of the cylindrical container. The winner is then easily able to collect the pot from the cylindrical container.

It is an object of this invention to provide a betting tray wherein the amount of money or tokens bet by each individual player is ascertainable at any time during play.

It is a further object of this invention to provide a betting tray which will physically deposit the individual bets of all players into a single receptacle for easy collection by the winner.

It is a further object of this invention to provide a segregated location for coins or tokens bet in order that scattering and mixing of coins or tokens with playing cards is avoided.

Other objects of the invention will become apparent upon reading the disclosure and claims which follow.

DETAILED DESCRIPTION OF THE PREFERRED EMBODIMENT

Figure 1:
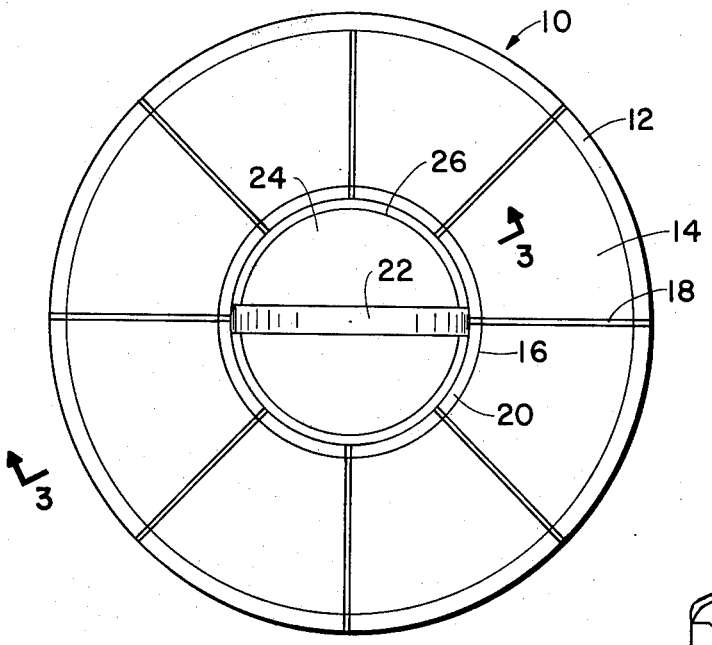
FIG. 1 is a top plan view of the assembled device.

Referring now to the plan view of the betting tray in FIG. 1, an annular tray indicated generally at 10 has an outer wall 12, a bottom 14 and an inner edge 16. The annular tray 10 is divided into equalsized wedge-shaped compartments by dividers 18 extending outward from a ring 20 at the inner edge 16 to the outer wall 12. A handle 22 is connected from one side of the ring 20 to the other. A cylindrical container 24 fills the center opening of the annular tray 10 with the outer wall 26 of the cylindrical container 24 adjacent to the inner edge 16 of the annular tray 10. Thus, objects placed in the compartments of the annular tray 10 are retained within the annular tray.

Figure 2:
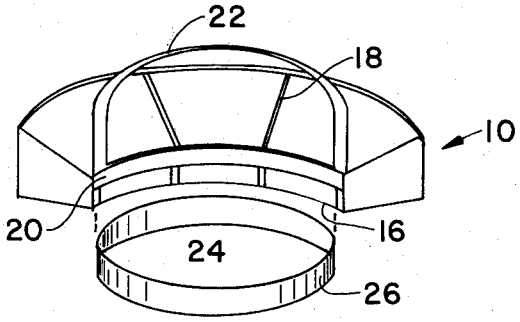
FIG. 2 is a partial exploded perspective view of the annular trag and cylinderical container.

Referring now to FIG. 2, it is seen that the bottom of the ring 20 is considerably above the inner edge 16 of the annular tray 10. The opening between the inner edge 16 and the ring 20 is sufficient to allow coins or betting tokens placed in any of the compartments to fall out except for the normal restraint provided by the side 26 of the cylindrical container 24. However, when the annular tray 10 is elevated as shown in the figure, the slot is clear of the side 26 thus enabling coins or betting tokens to fall into the cylindrical container 24 for easy retrieval by the winner.

Figure 3:
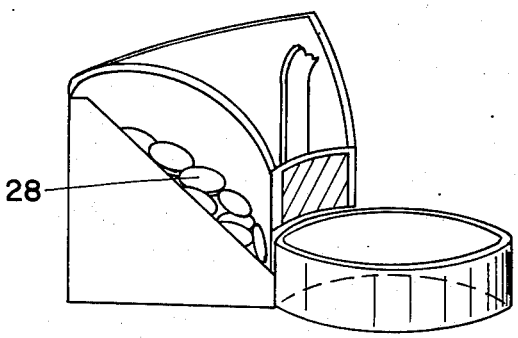
FIG. 3 is a view similar to FIG. 2 with the parts is assembled position.

FIG. 3 shows the coins or betting tokens 28 held in place in one of the compartments by the presence of the cylindrical container.

Figure 4:
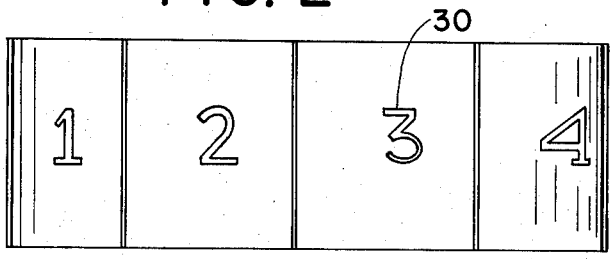
FIG. 4 is a front view of the annular tray.

FIG. 4 shows the indentifying numerals 30 affixed to the outer wall 12 which is preferably made of transparent material to facilitate inspection of the contents.

It is to be understood that the preceding description of the preferred embodiment is not to be taken as limiting the inventive concept to the precise structure disclosed. Instead, the invention and claims appended hereto include both the embodiment shown as well as all reasonable equivalents thereto.

What is claimed is:

1. A betting tray comprising:

annular holding means;

said annular holding means having at least two radially directed vertical dividers whereby said annular holding means is divided into at least two compartments:

said annular holding means having means for urging objects placed therein into a center opening;

restraining means to prevent said objects from being urged into the center of said annular holding means;

means for simultaneously terminating the effect of said restraining means in all of said at least two compartments whereby said objects are allowed to be moved into the center opening of said annular holding means; and collecting means wherein said objects from all of said at least two compartments become deposited when they are moved into the center opening of said annular holding means.

2. The betting tray recited in claim 1, wherein said annular holding means further comprises:

an annular tray;

an outer wall surrounding said annular tray;

wedge-shaped compartments dividing said annular tray into equal areas.

3. The betting tray recited in claim 2 wherein identifying numerals are affixed on said outer wall adjacent to each of said compartments.

4. The betting tray recited in claim 2, wherein said urging means comprises an inward and downward slope to the bottom of said annular tray.

5. The betting tray recited in claim 1, wherein said means to prevent comprises the sides of a cylindrical container fitted into the center opening of said annular holding means.

6. The betting tray recited in claim 5, wherein said means for terminating comprises elevating said annular holding means until it clears the sides of said cylindrical container.

7. The betting tray recited in claim 6, wherein said collecting means comprises the interior of said cylindrical container.

* * * * *